United States Patent [19]

Akashi

[11] 4,232,432

[45] Nov. 11, 1980

[54] SEPARABLE SLIDE FASTENER

[75] Inventor: Shunji Akashi, Kurobe, Japan

[73] Assignee: Yoshida Kogyo K.K., Tokyo, Japan

[21] Appl. No.: 78,931

[22] Filed: Sep. 26, 1979

[30] Foreign Application Priority Data

Oct. 9, 1978 [JP] Japan ..... 53-138698[U]
Oct. 9, 1978 [JP] Japan ..... 53-138699[U]

[51] Int. Cl.[3] ..... A44B 19/40
[52] U.S. Cl. ..... 24/205.11 R; 24/205.11 F
[58] Field of Search ..... 24/205.11 R, 205.11 F

[56] References Cited

U.S. PATENT DOCUMENTS

| | | | |
|---|---|---|---|
| 3,224,061 | 12/1965 | Taylor | 24/205.11 R |
| 3,485,691 | 12/1969 | Waldes | 24/205.11 F X |
| 3,490,970 | 1/1970 | Heimberger | 24/205.11 F X |
| 3,964,137 | 6/1976 | Kihara | 24/205.11 F X |
| 4,001,922 | 1/1977 | Ward, Jr. | 24/205.11 F |
| 4,045,845 | 9/1977 | Kando | 24/205.11 F |
| 4,047,264 | 9/1977 | Takahashi | 24/205.11 R |

FOREIGN PATENT DOCUMENTS

| | | | |
|---|---|---|---|
| 2339887 | 3/1975 | Fed. Rep. of Germany | 24/205.11 F |

*Primary Examiner*—Roy D. Frazier
*Assistant Examiner*—Peter A. Aschenbrenner
*Attorney, Agent, or Firm*—Bucknam and Archer

[57] ABSTRACT

A separable slide fastener comprises a pair of oppositely disposed stringers each having a support tape and a fastener element formed from a plastic monofilament into a continuous structure having coupling head portions, upper legs, lower legs and connecting heel portions and secured by sewn seams to a longitudinal inner edge of the respective tape, a reinforcing core extending through the coiled fastener element and a slider having a pair of branched guide channels defined between its flanges and diamond. A group of successive loops of the fastener element are fused together over a predetermined length at one end of the fastener and cut closely along the sewn seams to provide a pair of integrated pin members on the respective stringers. The group of fused loops on one stringer has a plurality of coupling head portions transferred from the other stringer. One of the pin members includes a locking lug having a transverse length substantially equal to or slightly greater than the width of one of the branched guide channels of the slider.

5 Claims, 8 Drawing Figures

SEPARABLE SLIDE FASTENER

BACKGROUND OF THE INVENTION

1. Field of the Invention

This invention relates to improvements in and relating to slide fasteners of a separable construction, and more particularly to such a slide fastener which is equipped with two separate sliders to permit the fastener to be opened and closed in opposite directions.

2. Prior Art

There have been proposed numerous slide fasteners having a separator constituted by a pin member and a socket member releasably interengageable therewith. Pin members according to one known method were formed either by injecting a thermoplastic material into the region of a fastener tape edge where the fastener elements had been previously removed, or by attaching a preformed pin member to such element-free tape edge. This method was complicated and time-consuming, involving the removal of fastener elements, or attaching separate pin members to the tape edge. Another known method of forming a pin member was to fuse a theremoplastic film integrally with a length of fastener elements on a pair of stringers which had been coupled together. Neither of these methods is satisfactory in respect of the cost involved in using extra material, particularly expensive plastic material. A further drawback was encountered with the prior art separable fasteners in that terminal ones of fastener elements were often loosened up or shifted out of position with the results that the fastener elements were prone to undergo "mis-meshing" or consequent "rupture" or separation of meshed element chains during use of the fastener.

There was another drawback of the conventional form of separable slide fastener in that the slider was required to be mounted on one of the two stringers from the upper end thereof remote from the lower end to which the pin member having a slider-locking part is affixed. This slider mounting operation, usually manual, was tedious and laborous particularly where the fastener is relatively long as in the case of reversibly separable slide fasteners having two oppositely oriented sliders or "loop" fasteners having a single stringer. With sliders mounted on the stringers prior to attachment of pin members, then the sliders would often present themselves to be an obstacle to the mounting of pin members or to the sewing of stringers onto a garment fabric.

SUMMARY OF THE INVENTION

It is therefore a primary object of this invention to provide a separable slide fastener incorporating structural features which will eliminate the foregoing drawbacks of the prior art.

A more specific object of the invention is to provide a slide fastener of the separable type which has separator pin members formed with a minimum of added material.

Another specific object of the invention is to provide a slide fastener of the separable type which has separator pin members contiguous to terminal ones of fastener elements on a pair of stringers and so formed as to retain a terminal or first meshing fastener element on one of said stringers in a proper meshing position with respect to another terminal or first meshing element on the other stringer.

A further specific object of the invention is to provide a slide fastener of the separable type having separator pin members each formed integrally with the portions of longitudinal inner edges of the respective stringers on which fastener elements are mounted, one of said pin members having a locking lug configured to releasably engage in one of the branched guide channels of the slider.

Still another specific object of the invention is to provide a slide fastener of the fully separable type which has a separator to permit two sliders to be operatively mounted on the fastener stringer or stringers.

According to the present invention, there is provided a separable slide fastener comprising a pair of oppositely disposed stringers each having a support tape and a fastener element formed from a plastic monofilament into a continuous structure secured by sewn seams to a longitudinal inner edge of the respective tape; the fastener element consisting of a succession of elongated loops each having a coupling head portion at one end thereof, an upper leg, a lower leg and a connecting heel portion at the opposite end remote from the coupling head connected to a next adjacent one of the successive loops; a reinforcing core extending through said succession of loops; and a slider having a pair of branched guide channels defined between its flanges and its diamond; a group of said successive loops being fused together over a predetermined length of the two coupled stringers at one end of the fastener and cut closely along the sewn seams to provide a pair of integrated pin members on the respective stringers, the group of fused loops on one stringer having a plurality of coupling head portions transferred from the other stringer.

These and other objects and features of the invention will become manifest to those versed in the art by referring to the detailed description which follows with reference to the accompanying drawings.

DETAILED DESCRIPTION OF THE PREFERRED EMBODIMENT

Figure 1:
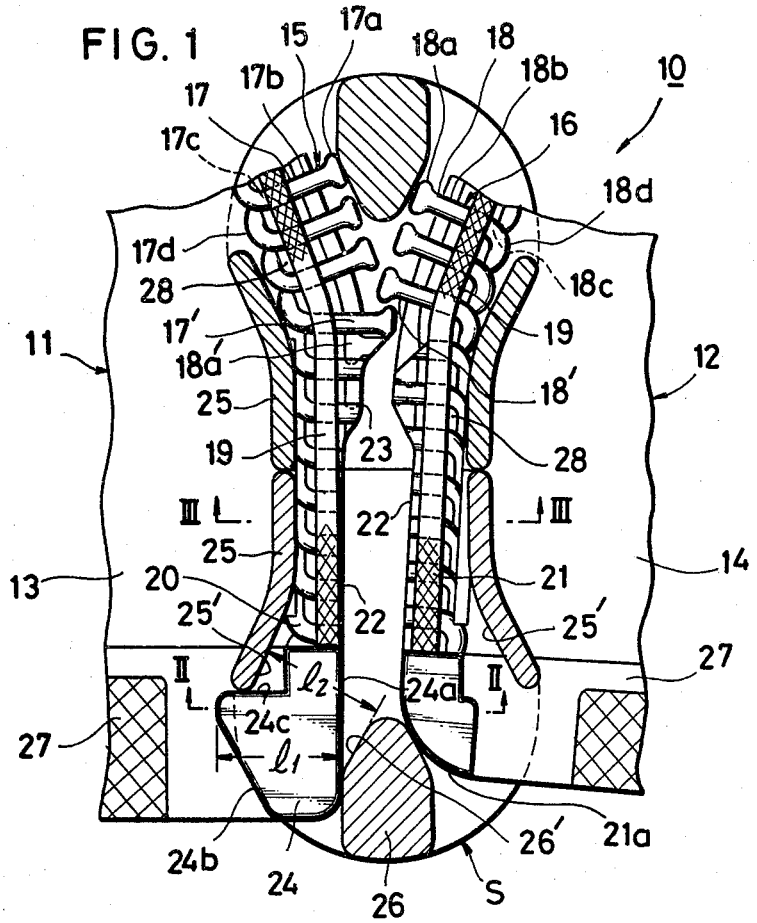
FIG. 1 is a fragmentary plan view, on enlarged scale, of a pair of slide fastener stringers according to the invention with two oppositely directed sliders mounted thereon.
Figure 2:
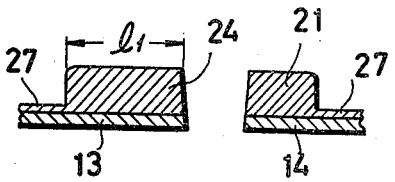
FIG. 2 is a cross-sectional view taken on the line II—II of FIG. 1.
Figure 3:
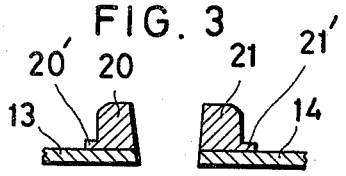
FIG. 3 is a cross-sectional view taken on the line III—III of FIG. 1.

Referring now to the drawings and FIG. 1 in particular, there is shown for purposes of illustration an important portion of a separable slide fastener 10 provided in accordance with the principles of the invention. The fastener 10 comprises a pair of oppositely disposed stringers 11, 12 each having a support tap 13, (14) and a row of interlocking fastener elements 15, (16) mounted on and along a longitudinal inner edge of the respective tape. The fastener element 15, (16) is formed from a plastic monofilament into a continuous coil, meandering or zig-zag structure, the element 15, (16) being shown in the illustrated embodiment to be a helically coiled structure consisting of a succession of elongated convolutions or loops 17, (18) each having a coupling head portion 17*a*, (18*a*) at one end thereof, an upper leg 17*b*, (18*b*), a lower leg portion 17*c*, (18*c*) extending from the head 17*a*, (18*a*) in a common direction and a connecting heel or turn portion 17*d*, (18*d*) at the opposite end remote from the head 17*a*, (18*a*) connected to a next adjacent one of the successive loops 17, (18).

The coupling head 17*a* of the loop 17 on one stringer 11 is dimensioned to releasably couple with the corresponding head 18*a* of the loop 18 on a mating stringer 12 to open and close the fastener 10 in the well-known manner. The upper and lower legs 17*b* and 18*b* are spaced apart in substantially superimposed relation to each other as shown in FIG. 1 and define therebetween a longitudinally extending "tunnel" or hollow conduit through which a reinforcing string, cord or core 28 is inserted. Designated at 19 is a sewn seam or stitching securing the row of loops 17, (18) to the respective tape 13, (14).

In accordance with the principles of the invention, the successive loops 17, (18) that have been coupled or meshed with each other are fused together over a predetermined length of the row of loops at one end of the fastener 10 as by means of a supersonic processing and cut closely along a longitudinal inner edge of each of the sewn seams 19 to provide a pair of integrated pin members 20 and 21 on opposed stringers 11 and 12, respectively. Fusing the plastic monofilament element 15, (16) causes its stock to melt and penetrate into the interstices of the fabric forming the sewn seam 19, reinforcing core 28 and support tapes 13, 14, with the results that all of these parts of the fastener 10 are intimately united. The pin members 20 and 21 that result from cutting or removing portions of the fused region of the stringers 11, 12, of which a first portion 22 extends longitudinally closely along and substantially in parallel with the inner edges of the respective sewn seams 19, with the coupling head portions 17*a*, (18*a*) of the element 15, (16) completely removed. A second portion 23 of the fused and cut region is tapered off with a plurality of coupling heads of the successive loops 17 on one stringer 11 transferred to and anchored between adjacent ones of the successive loops 18 on the opposite companion stringer 12, or vice versa, as shown in FIG. 1. The cutting takes place in the second portion 23 so that the first meshing or terminal loops 17', 18' remain underformed. The coupling head 18*a*' in particular which has been transferred by cutting of the second portion 23 of the fused region from one stringer 12 to the other stringer 11 is fused integrally with the first meshing or terminal loop 17' on the stringer 11 so as to mechanically strengthen this loop 17', which would otherwise be unstable, and further hold the same in the proper meshing position with respect to the mating first meshing or terminal loop 18' on the stringer 12, so as to prevent "over-running" of one stringer 12 relative to the other stringer 11 when the second pin member 21 is inserted into a slider S as shown in FIG. 1. The correct intermeshing of the two opposed first loops 17' and 18' thus provided ensures smooth coupling of the respective stringers 11, 12 without rupture or separation of the element chains.

Figure 4A:
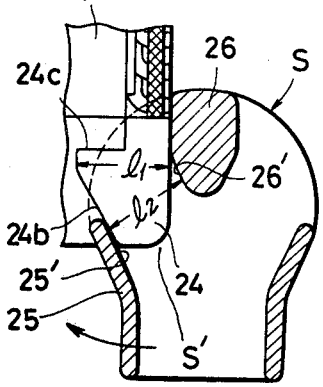
FIG. 4*a*–4*e*, inclusive, are views utilized to explain the manner of mounting a slider on one of the fastener stringers.
Figure 4B:
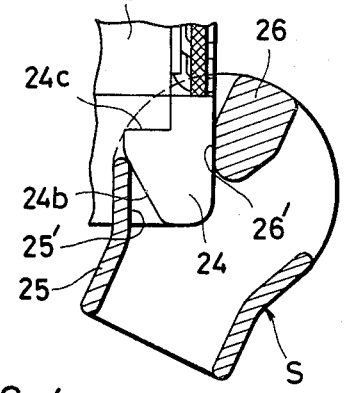
Figure 4C:
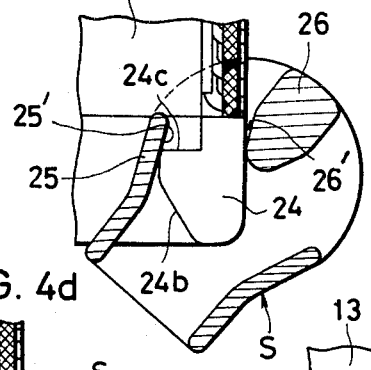
Figure 4D:
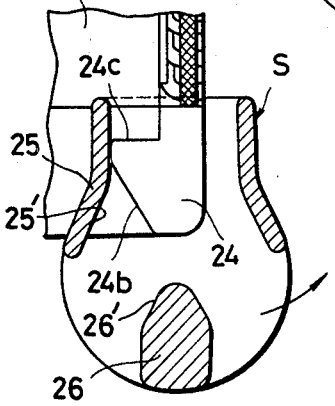
Figure 4E:
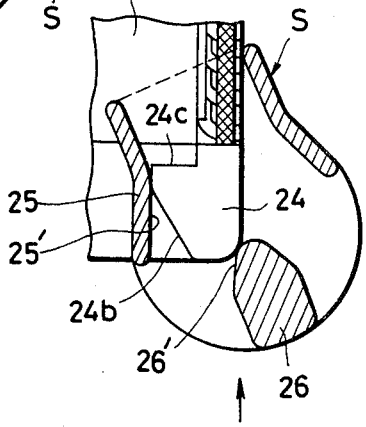

One of the paired pin members or the first member 20 includes a locking lug 24 which is formed integrally therewith at the lower-most end of the stringer 11 for locking engagement with the slider S. The locking lug 24 has a straight marginal edge 24*a* coextensive with the edge of the first cut-out portion 22 on the stringer 11, a curved peripheral portion 24*b* and a locking surface 24*c* extending transversely of the stringer 11 for abutting engagement with the end of one of the flanges 25, 25 of the slider S. To provide effective locking of the locking lug 24 with the slider S, the width or transverse length l1 of the lug 24 is calculated to be substantially equal to or slightly greater than the distance or spacing l2 between one of the flanges 25, 25 and a diamond 26 of the slider S; more specifically between a flared flange portion 25' and an inclined diamond surface 26', defining therebetween one of the branched guide channels S' of the slider S, the arrangement being that when threading the stringer 11 through the slider S progressively from the position of FIG. 4*a*, then the position of FIG. 4*b* to the position of FIG. 4*c*, the locking lug 24 undergoes slight elastic deformation in frictional contact with the flange 25 and diamond 26 of the slider S as the lug 24 is moved into the slider S through rotation only in the plane of the fastener 10. The stringer 11 may be further threaded through another slider S in the manner shown in FIGS. 4*d* and 4*e* in the case where the fastener 10 is desired to be reversibly opened and closed with use of two sliders S as is well known in the art.

Each of the pin members 20, 21 is provided with a linear reinforcing guide portion 20', (21') formed by deformation of the heel or turn portions 17*d*, (18*d*) simultaneously with the fusing of the element 15, (16), which guide portion 20', (21') facilitates the insertion of the stringer 11, (12) with least frictional resistance through the slider S.

The other or second pin member 21 has a rounded inner peripheral surface 21*a* engageable with the diamond 26 of the slider when the stringer 12 is threaded through the latter, in which position the first meshing loop 18' on the stringer 12 is brought into engagement with the first meshing loop 17' on the mating stringer 11 in the space between the loops 17' and the next adjacent one of the successive loops 17.

Designated at 27 is a reinforcing plastic film enveloping the lower end portions of the respective stringers 11, 12, which serves to prevent fraying of the threads of sewn seam 19, support tapes 13, 14 and reinforcing core 28 and at the same time to facilitate finger-gripping of the stringers 11, 12 when threading the latter through the slider S.

Although various minor modifications may be suggested by those versed in the art, it should be understood that I with to embody within the scope of the patent warranted hereon, all such embodiments as reasonably and properly come within the scope of my contribution to the art.

What is claimed is:

1. A separable slide fastener comprising a pair of oppositely disposed stringers each having a support tape and a fastener element formed from a plastic monofilament into a continuous structure secured by sewn seams to a longitudinal inner edge of the respective tape; the fastener element consisting of a succession of elongated loops each having a coupling head portion at one end thereof, an upper leg, a lower leg and a connecting heel portion at the opposite end remote from the coupling head connected to a next adjacent one of the successive loops; a reinforcing core extending through said succession of loops; and a slider having a pair of branched guide channels defined between its flanges and its diamond; a group of said successive loops being fused together over a predetermined length of the two coupled stringers at one end of the fastener and cut closely along the sewn seams to provide a pair of integrated pin members on the respective stringers, the group of fused loops on one stringer having a plurality of coupling head portions transferred from the other stringer.

2. A separable slide fastener as claimed in claim 1 wherein one of said pin members includes a locking lug having a transverse length substantially equal to or slightly greater than the width of one of said branched guide channels of the slider.

3. A separable slide fastener as claimed in claim 1 wherein said fused loops are united integrally with said sewn seams, said tape and said reinforcing core.

4. A separable slide fastener as claimed in claim 2 wherein said locking lug is dimensioned to be rotatable in the plane of the fastener when the threading its associated stringer through the slider.

5. A separable slide fastener as claimed in claim 1 including a first meshing or terminal loops on one of the stringers extending integrally from the group of fused loops and underformed to permit intermeshing with another terminal loop on the other stringer.

* * * * *